United States Patent [19]

Van Hemmen et al.

[11] 4,227,301

[45] Oct. 14, 1980

[54] SHAVING APPARATUS

[75] Inventors: Dirk J. Van Hemmen; Albert Hoekstra, both of Drachten, Netherlands

[73] Assignee: U.S. Philips Corporation, New York, N.Y.

[21] Appl. No.: 946,512

[22] Filed: Sep. 28, 1978

[30] Foreign Application Priority Data

Nov. 28, 1977 [NL] Netherlands ..... 7713040

[51] Int. Cl.[2] ..... B26B 19/14

[52] U.S. Cl. ..... 30/43.6; 30/346.51

[58] Field of Search ..... 30/34.2, 43.4–43.92, 30/346.51; 76/104 R

[56] References Cited

U.S. PATENT DOCUMENTS

| | | | |
|---|---|---|---|
| 2,616,168 | 11/1952 | Dankers | 30/346.51 X |
| 2,616,169 | 11/1952 | Hofland | 30/346.51 X |
| 3,116,551 | 1/1964 | Anton | 30/346.51 X |
| 3,648,367 | 3/1972 | Tolmie | 30/346.51 X |
| 3,800,417 | 4/1974 | Tietjens | 30/346.51 X |

*Primary Examiner*—Gary L. Smith

*Attorney, Agent, or Firm*—Thomas A. Briody; William J. Streeter; Rolf E. Schneider

[57] ABSTRACT

There is provided a rotary shaving apparatus having a shear plate formed with hair-entrance apertures and a cutting member associated with and rotatable relative to the shear plate. The cutting member is substantially constituted by a central body provided with cutters extending only from its circumference. The cutters are arranged in a plurality of groups, the intervals between adjoining cutters of each group being equal, such intervals differing from the respective intervals between the two adjacent cutters of two different groups.

3 Claims, 5 Drawing Figures

SHAVING APPARATUS

This invention relates to a shaving apparatus having a circular shear plate with hair-entrance apertures and a cutting member which is rotatable relative to the shear plate, which member is substantially constituted by a circular central body which is provided with cutters at its circumference.

Such a shaving apparatus is for example known from U.S. Pat. No. 3,992,775. The cutting member of this known apparatus is provided with six cutters spaced at regular intervals along its circumference. If the number of hair-entrance apertures is a multiplicity of the number of cutters, and the hair-entrance apertures are thus also regularly spaced along the circumference, it is possible that during use of the apparatus a hair will be cut at several points at the same time. This results in undesired peak loading of the drive mechanism of the apparatus.

The present invention, whose object it is to eliminate this drawback, leads to a construction which is characterized in that the cutters are arranged in groups with equal internvals between the adjoining cutters of a group, which intervals differ from the intervals between the two adjacent cutters of two different groups.

A special embodiment is characterized in that the groups comprise equal numbers of cutters and the groups are arranged rotation-symmetrically along the circumference of the cutting member.

The construction may also be such that the intervals between the two adjacent cutters of two different groups are different.

The invention is also embodied in a cutting member as employed in a shaving apparatus as defined hereinbefore.

The invention will now be described in detail in connection with the accompanying drawings, in which.

Figure 1:
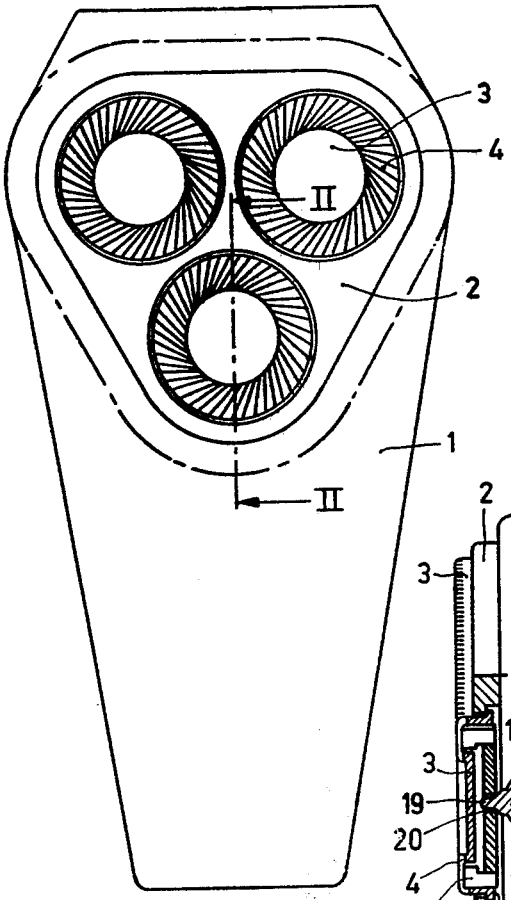
FIG. 1 shows an elevation of a shaving apparatus having three shear plates.
Figure 2:
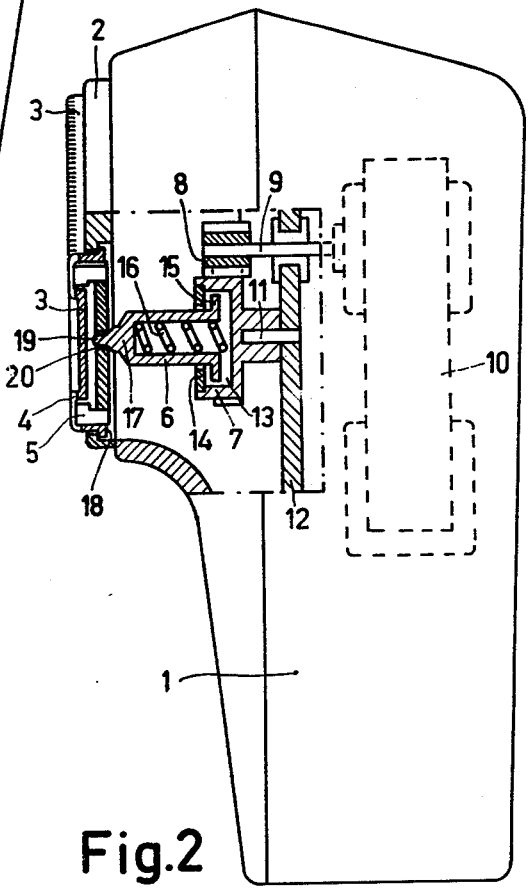
FIG. 2 shows the shaving apparatus of FIG. 1 in side view and partly in a cross-section taken on the line II—II in FIG. 1.

The shaving apparatus in accordance with FIGS. 1 and 2 comprises a housing 1, of which a part takes the form of a shear plate holder 2 for three shear plates 3. The shear plates 3 have hair-entrance apertures 4.

As shown in the partial cross-section of FIG. 2 a cutting member 5 is disposed on the inner side of a shear plate 3. Said cutting member 5, which for the sake of clarity is only shown schematically in FIG. 2, is shown in detail and on an enlarged scale in FIGS. 3 and 4.

The cutting member 5 is coupled to the electric motor 10 by means of the hollow spindle 6 (FIG. 2), the gear wheels 7 and 8 and the spindle 9, so that the cutting member is rotatable relative to the associated shear plate 3. The gear wheel 7 is rotatably journalled on a pin 11 which is mounted in a mounting plate 12. The gear wheel 7 has a recess 13 which is closed by a cover plate 14. This recess accommodates the flange 15 at the end of the hollow spindle 6. By giving the flange 15 a non-round, for example square, shape and by shaping the recess 13 accordingly, a coupling is established for the transmission of the rotary movement of the gear wheel 7 to the spindle 6. The spring 16, which for its greater part is situated in the hollow spindle 6 and which is tensioned between the hollow spindle 6 and the gear wheel 7, exerts a force on the spindle 6 in the direction of the cutting member 5. As the cylindrical portion 17 of the spindle 6 bears against the cutting member 5, this force is exerted on the cutting member and via the cutting member on the shear plate 3, so that the shear plate is urged against the shear plate holder 2 along the flanged edge 18. As a result of external forces, as may for example occur during use of the shaving apparatus, the shear plate 3 together with the cutting member 5 and the spindle 6 can be pressed inwards against the action of the spring 16.

The coupling for the transmission of the rotary movement between the spindle 6 and the cutting member 5 is obtined in that the spindle 6 is provided with an end 19 of substantially rectangular cross-section. This end 19 engages with a corresponding coupling opening 20 of the cutting member 5.

The coupling to the electric motor 10 as described in the foregoing is identical for the three cutting members of the apparatus in accordance with FIGS. 1 and 2, the three gear wheels 7 being in engagement with a single centrally disposed gear wheel 8 on the motor spindle 9.

Figure 4:
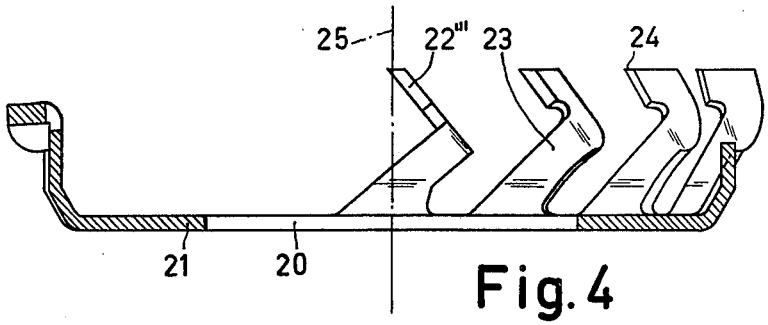
FIG. 4 shows a cross-section taken on the line IV—IV in FIG. 3.
Figure 3:
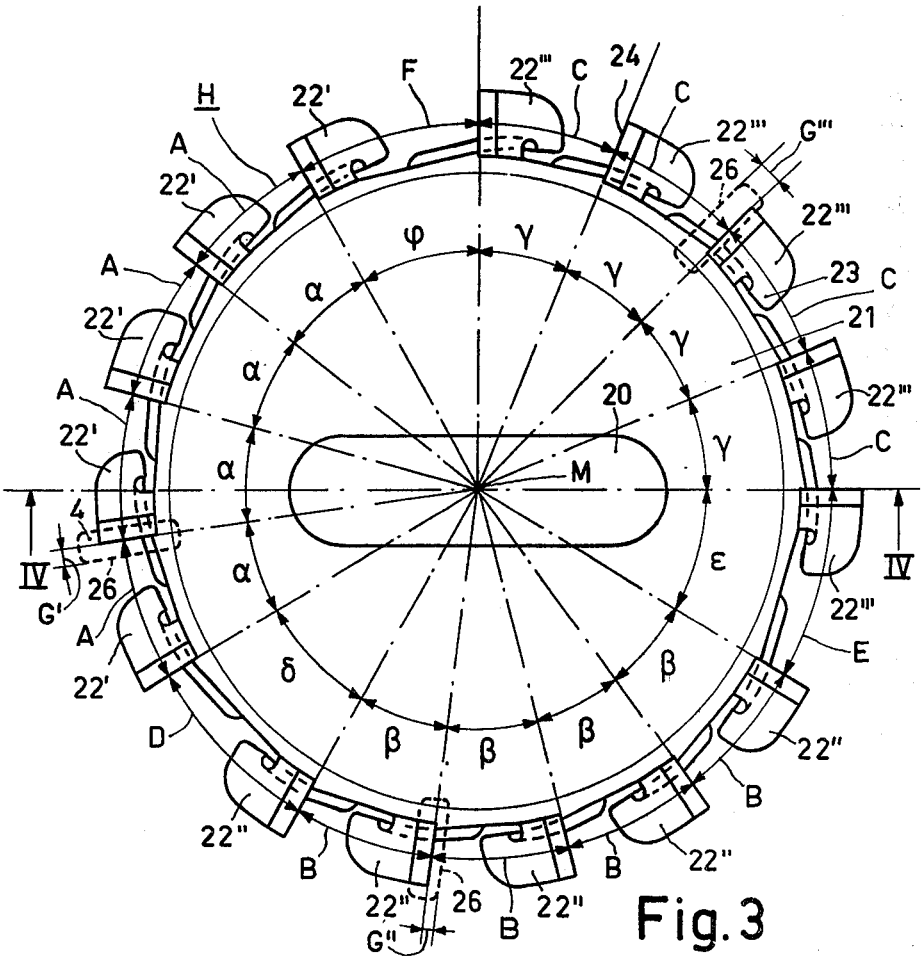
FIG. 3 shows a plan view on an enlarged scale of a cutting member.

The cutting member 5, as shown in FIGS. 3 and 4, comprises a central body 21 with the coupling recess 20. The cutting member is provided with fifteen cutters 22', 22'', and 22''' which are each connected to the central body 21 by means of the respective connecting arms 23 and which are provided with cutting edges 24. The assembly is for example manufactured from an originally flat sheet material. The fifteen cutters are disposed on a circle H having a centre M and are arranged in three groups of five cutters 22', 22'', and 22'''.

the radians from the centre M of the cutting member, which pass through the cutting edges 24 of the cutters 22' which belong to one group, make an angle $\alpha$ with each other. The intervals, as represented by the length of arc A associated with each angle $\alpha$, are constant for the cutters 22'. The intervals for the cutters 22'' and 22''' are represented by the lengths of arcs respectively accociateed with the angles $\beta$ and the lengths of arcs C respectively associated with the angles $\gamma$. The angles $\alpha$, $\beta$ and $\gamma$, and thus the lengths of arcs A, B and C are equal to each other in the present embodiment, but A, B and C may also be of different lengths.

The intervals between the adjacent cutters of two different groups are determined by the angles $\delta$, $\epsilon$ and $\phi$ and are represented by the lengths of arcs D, E and F. In the present embodiment the angles $\delta$, $\epsilon$ and thus the lengths of arcs D, E and F are equal to each other, so that the cutter groups are arranged rotation-symmetrically relative to the axis of rotation 25 which passes through M (FIG. 4). Arcs D, E and F may also be of different lengths. The lengths of arcs D, E and F differ from the length of the arc between two cutters of an adjacent group.

If the cutter member for example cooperates with a shear plate having ninety hair-entrance apertures which are regularly spaced over the circumference of the shear plate, this substantially reduces the risk that two or more cutters simultaneously contact a hair and cut it off in cooperation with the shear plate. The intervals represented by the lengths of arcs D, E and F are then selected such that in an arbitrary position of the cutting member relative to the shear plate the distance G' from the cutting edge 24 of a cutter 22' to the edge 26 of an adjacent hair-entrance aperture 4, represented by dashed lines in FIG. 3, differs from the corresponding distances G'' and G''' of the cutters of the other groups.

Thus, peak loading of the electric motor 10, as may occur if several hairs in different hair-entrance apertures simultaneously meet a cutter so that in a short time the motor is required to deliver the energy for cutting several hairs, is substantially avoided.

The likelihood that at the same time several hairs in different hair-entrance apertures will meet a cutter increases according as the cutting member has more cutters. The arrangement of the cutters in groups will therefore be more advantageous according as the number of cutters increases.

Figure 5:
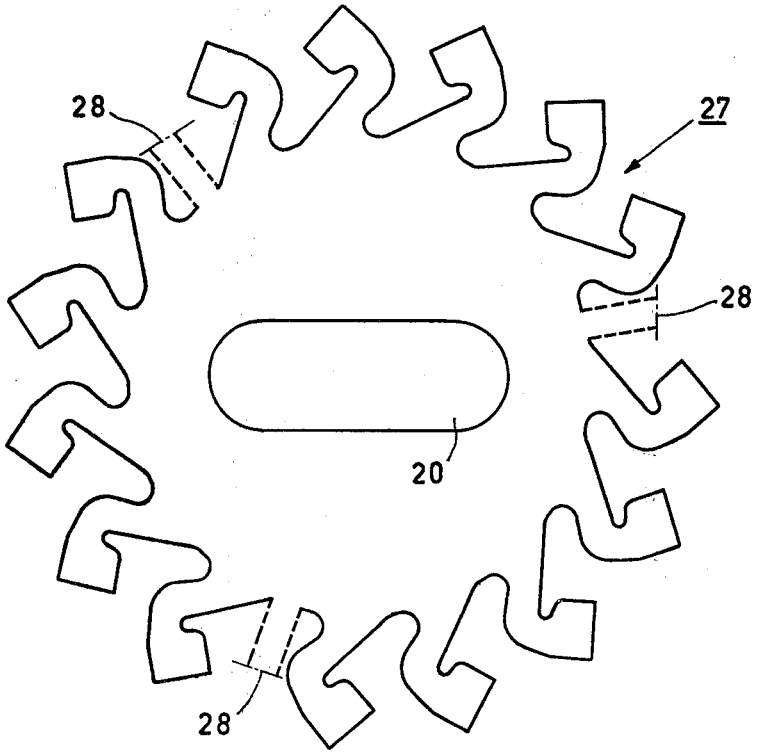
FIG. 5 is a development on an enlarged scale of a cutting member in a flat plane.

An additional advantage concerns the manufacture of the cutting member, which is generally done starting from a strip of sheet material from which several flat blanks of the cutting member are obtained. Inter alia for transport purposes it is often interesting that during the first stage of manufacture the blanks are still attached to the strip. The intervals D, E and F, which will generally be selected greater than the intervals A, B and C, now also provide sufficient space for a thin connecting link by means of which the blank can be connected to the remaining material of the strip. At a later stage of manufacture this connecting link may then be removed. A blank 27, i.e. a development of the cutter member in a flat plane, is shown in FIG. 5. In this Fig. a part of the connecting links 28 is represented by dashed lines.

What is claimed is:

1. A shaving apparatus having a circular shear plate provided with hair-entrance apertures; a cutting member associated with and rotatable relative to the shear plate, said cutting member being substantially constituted by a circular central body; and cutters extending only from the circumference of said central body toward the shear plate, said cutters being arranged in a plurality of groups, the intervals between adjoining cutters of each group being equal, said intervals differing from the respective intervals between the two adjacent cutters of two different groups.

2. A shaving apparatus according to claim 1, in which the groups each comprise equal numbers of cutters, and the groups are arranged rotation-symmetrically along the circumference of the cutting member.

3. A shaving apparatus according to claim 1 or 2, in which the intervals between the two adjacent cutters of two different groups are different.

* * * * *